US006675502B1

(12) United States Patent
Chen

(10) Patent No.: US 6,675,502 B1
(45) Date of Patent: Jan. 13, 2004

(54) INTEGRATED INJECTION FORMING SHOE MIDSOLE HAVING A DUAL-LAYER PAD

(76) Inventor: Sung-Ho Chen, No. 52-1, Pu-Tsei Rd., Pu-Nan Tsun, Pu-Yen Hsiang, Chang-Hua Hsien (TW)

( * ) Notice: Subject to any disclaimer, the term of this patent is extended or adjusted under 35 U.S.C. 154(b) by 0 days.

(21) Appl. No.: 10/086,241

(22) Filed: Mar. 4, 2002

(51) Int. Cl.[7] ..... A43B 13/12
(52) U.S. Cl. ..... 36/30 R; 36/28; 36/25 R
(58) Field of Search ..... 36/30 R, 28, 25 R, 36/30 A

(56) References Cited

U.S. PATENT DOCUMENTS 4,364,188 A * 12/1982 Turner et al. ..... 36/31
4,739,765 A * 4/1988 Sydor et al. ..... 36/174
4,852,274 A * 8/1989 Wilson ..... 36/29
5,657,556 A * 8/1997 Bemis ..... 36/30 R
6,098,313 A * 8/2000 Skaja ..... 36/28
2001/0032400 A1 * 10/2001 Brooks ..... 36/102

FOREIGN PATENT DOCUMENTS

WO 91/11124 * 8/1991

* cited by examiner

*Primary Examiner*—Ted Kavanaugh
(74) *Attorney, Agent, or Firm*—Birch, Stewart, Kolasch & Birch, LLP

(57) ABSTRACT

An integrated injection forming shoe midsole having a dual-layer pad includes a midsole and a dual-layer pad integrally formed by an injection forming process to form a tightly bonding between the midsole and the dual-layer pad. The dual-layer pad has a softer pliable pad on the upper layer and a harder and resilient cushion pad on the lower layer, and a buffer section corresponding to the heel location. Through the buffer section and the upper and lower-layers which have different material properties, the midsole may provide wearers more comfortable feeling and shock-absorbing bouncing resilience when touching ground surface.

3 Claims, 8 Drawing Sheets

INTEGRATED INJECTION FORMING SHOE MIDSOLE HAVING A DUAL-LAYER PAD

FIELD OF THE INVENTION

The present invention relates to an improved shoe midsole and particularly to an integrated injection forming shoe midsole that has a dual-layer pad made from a soft and a hard material to provide comfortable and resilient shock-absorbing effect.

BACKGROUND OF THE INVENTION

A common shoe outsole 1 now available on the market as shown in FIG. 1 generally has an outsole 1 and a midsole 2 made separately by injection forming or extrusion processes. Then a pad 3 is bonded to the midsole 2, mostly by using adhesive. The midsole 2 and pad 3 tend to separate or damage after wearing for a period of time. Moreover, the pad 3 or midsole 2 made from a single material usually is too soft and does not have sufficient resilience, or too hard and incurs too much pounding impact when touching the ground and gives wearers uncomfortable feeling. In order to give shoe outsoles better resilience or shock-absorbing effect, some producers have developed and introduced midsoles with built-in air pouches or hydraulic lumps. However force bearing surfaces and positions of the air pouches or hydraulic lumps cannot match wearer's foot, and they tend to give wearers an awkward feeling when wearers' foot stepping on the inflated air pouches or hydraulic lumps, especially on the heel section. As the air pouches or hydraulic lumps do not have sufficient force bearing surfaces and cannot completely absorb the impact when wearer's foot dropping on the ground, wearers' foot might even be hurt. Hence there is a need to develop an integrated forming midsole 2 and pad 3 to provide comfortable wearing and shock-absorbing effect to improve the shortcomings of poor bonding between the midsole and pad, and uncomfortable wearing that incurred to conventional shoes.

SUMMARY OF THE INVENTION

In view of aforesaid disadvantages, the primary object of the invention is to provide a shoe midsole and a dual-layer pad that are made by an integrated injection forming process to save assembly time of bonding and stitching, and to offer long period wearing without breaking away.

Another object of the invention is to provide a dual-layer pad that consists of a pliable pad and a cushion pad made from different soft and hard materials to offer people more comfortable and labor-saving walking.

A further object of the invention is to provide a dual-layer pad that has a plurality of jutting ribs on the peripheral rim and button latch openings to allow the dual-layer pad and midsole bonding tightly and securely without loosening off.

Yet another object of the invention is provide a dual-layer pad that has a buffer section to give wearers comfortable and shock-absorbing effect during walking, and give wearers resilient and labor-saving bounce when pulling the foot from the ground surface.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
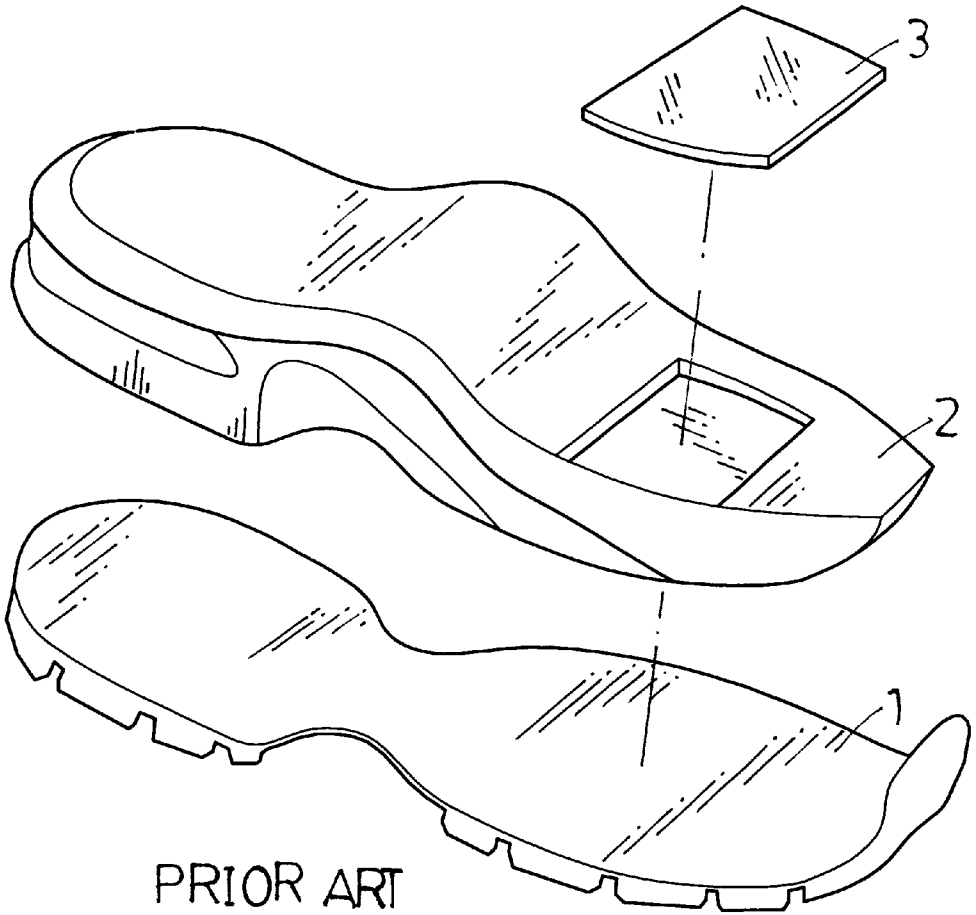
PRIOR ART Fig. 1
FIG. 1 is a schematic exploded view of a conventional shoe outsole.
Figure 2:
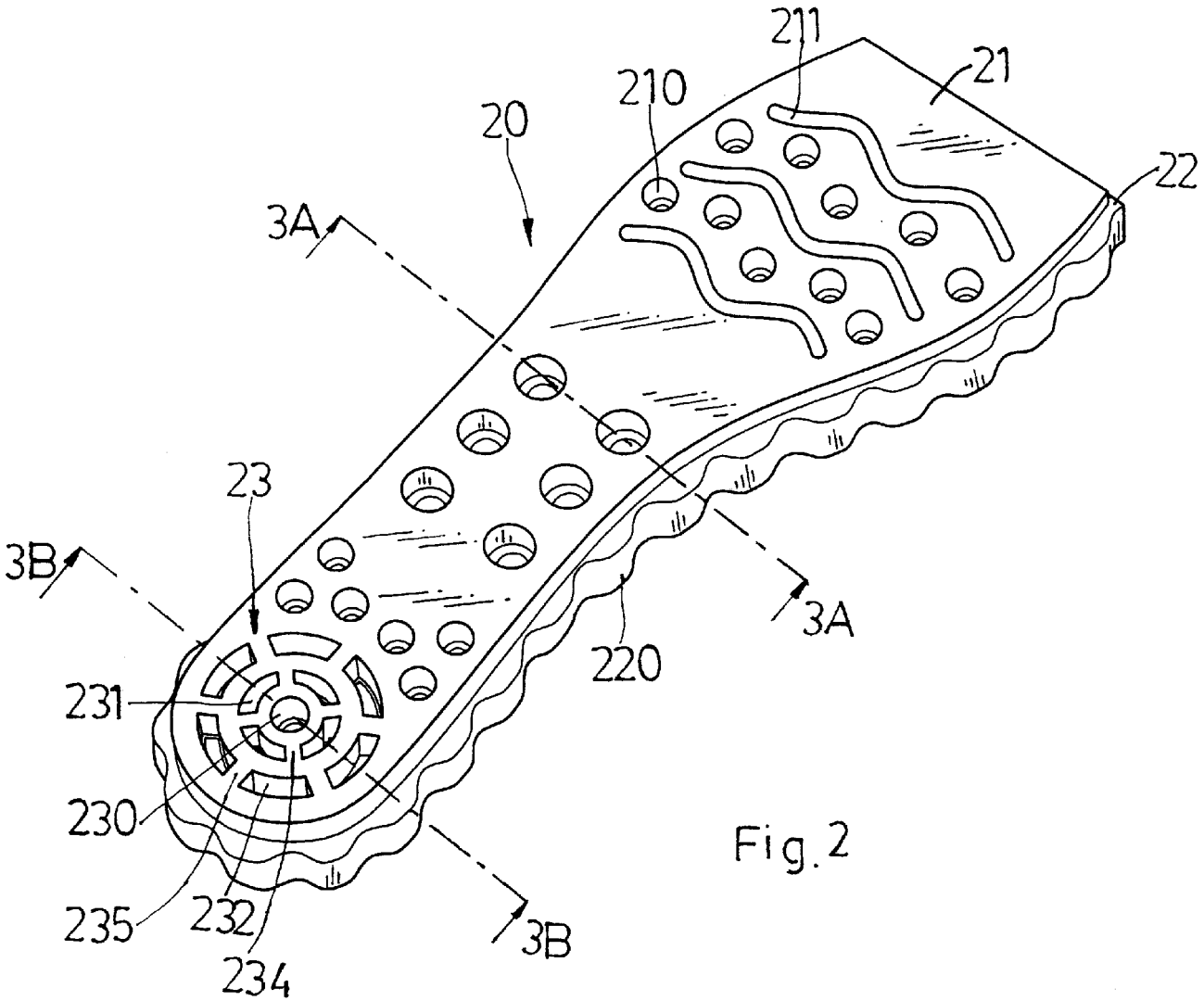
FIG. 2 is a perspective view of a dual-layer pad of the invention.
Figure 3B:
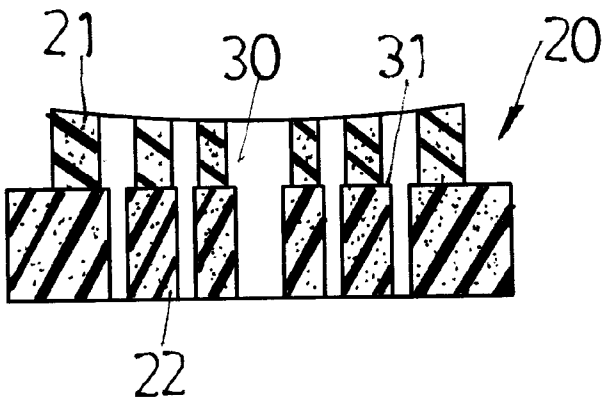
FIG. 3B is a cross section taken along line 3B—3B in FIG. 2.

Referring to FIGS. 2 through 3B , the invention aims to provide an improved dual-layer pad 20 that focuses on different natures of the sole and heel of a human foot to offer comfortable and durable wearing.

The dual-layer pad 20 is integrally formed in a midsole 10 before the midsole 10 is completely formed. The dual-layer pad 20 consists of a pliable pad 21 and a cushion pad 22 bonding together to form an upper layer and a lower layer.

Figure 3A:
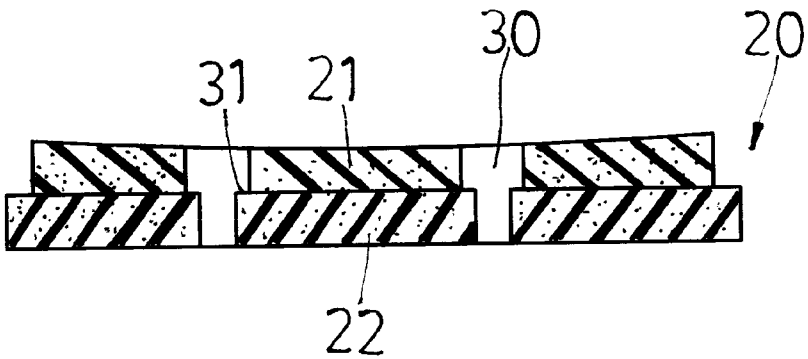
FIG. 3A is a cross section taken along line 3A—3A in FIG. 2.

The pliable pad 21 is made from SBS (Styrene-Butadien-Styrene triblock copolymer) or EVA (Ethyl-vinyl acetate), and has a plurality of latch openings 210 and undulate slots 211 formed on the surface. The latch openings 210 run through the dual-layer pad 20. The pliable pad 21 further has a buffer section 23 located in the heel section. The buffer section 23 has a top surface which has a center opening 230, an inner layer aperture 231 and an outer layer aperture 232 formed thereon from the center thereof extending outwards. The top surface has a concave and arched contact surface 233. The center opening 230, inner layer aperture 231 and outer layer aperture 232 are formed symmetrically and run through the dual-layer pad 20. The inner layer aperture 231 and outer layer aperture 232 are bridged by inner ribs 234 and outer ribs 235 located therebetween in a stagger fashion. In addition, the latch openings 210, center opening 230, inner layer aperture 231 and outer layer aperture 232 have respectively larger diameters in the pliable pad 21 than in the cushion pad 22 to form button latch openings 30 with a wider upper section and a narrower lower section (as shown in FIGS. 3A and 3B).

Figure 4:
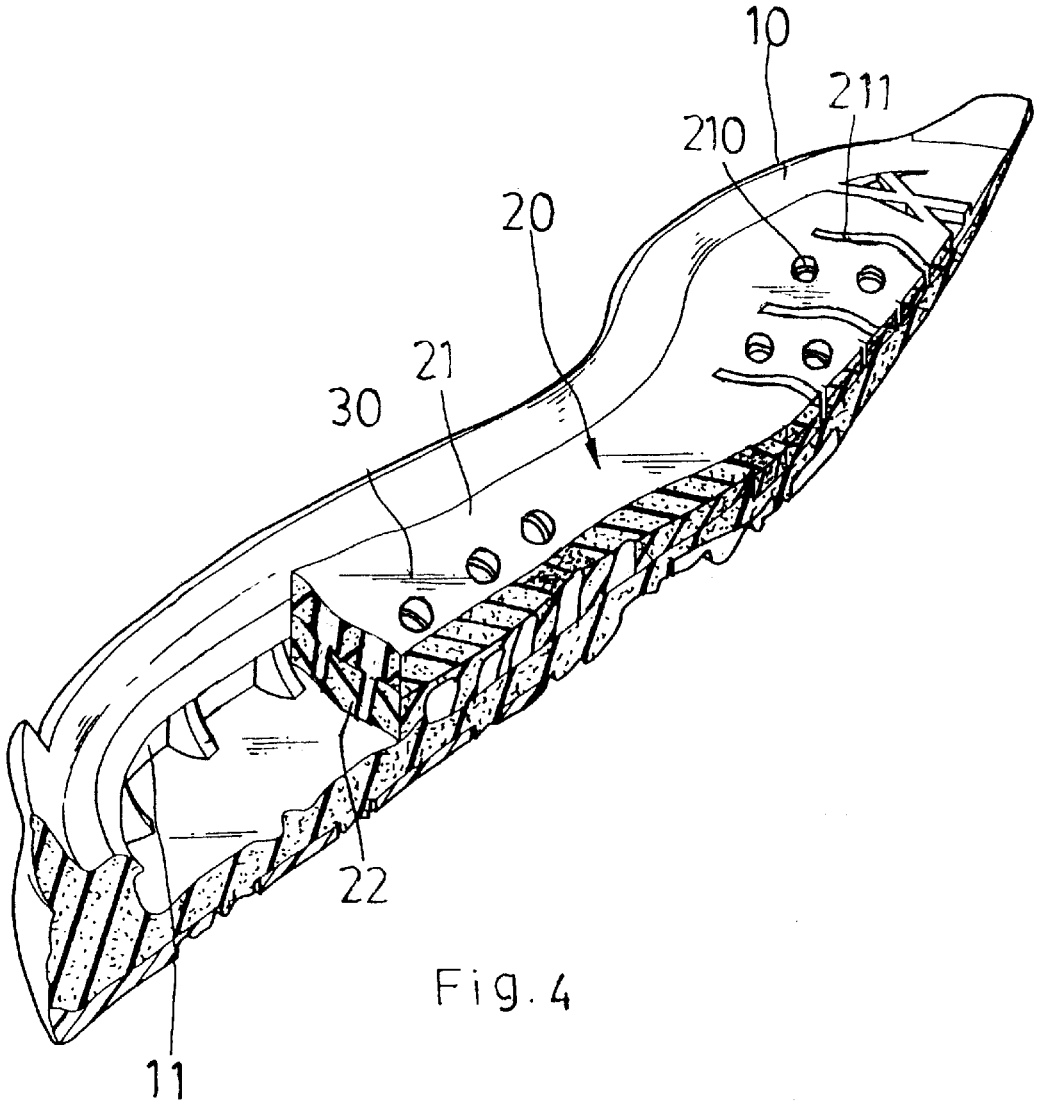
FIG. 4 is a sectional view of the invention, with the dual-layer pad bonding to a midsole.

The cushion pad 22 also is made from SBS (Styrene-Butadien-Styrene triblock copolymer), but is slightly harder than the pliable pad 21 to increase support and resilient property. Moreover, the cushion pad 22 has a plurality of jutting ribs 220 formed on the peripheral rim thereof. The jutting ribs 220 and rib slots 11 formed on the periphery of the midsole 10 are located in a staggered and alternate manner relative to one another. Such a design allows the cushion pad 22 securely bonding to the midsole 10 when the dual-layer pad 20 is integrally formed with the midsole 10 by an injection forming process (shown in FIG. 4).

Figure 5B:
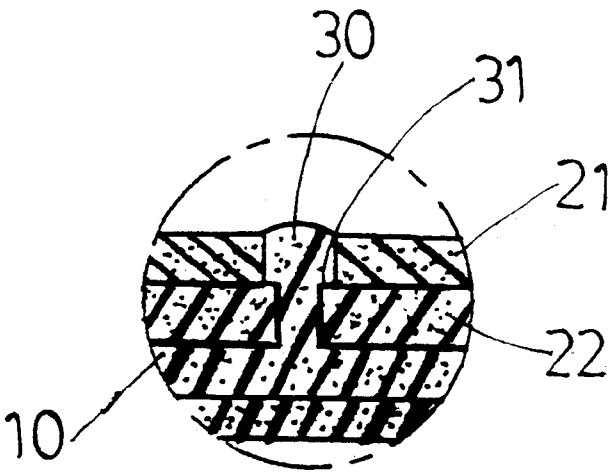
FIG. 5B is a fragmentary enlarged cross section according to FIG. 5A.
Figure 5A:
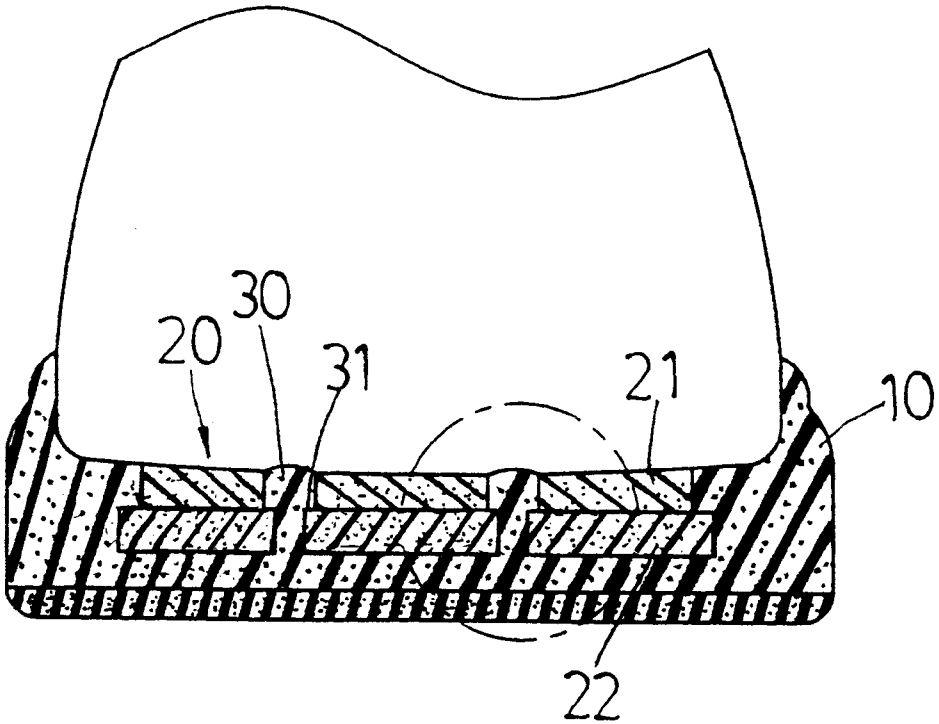
FIG. 5A is a fragmentary cross section of the dual-layer pad and outsole according to the invention.

In addition, when the midsole 10 is formed by injection and covers the entire dual-layer pad 20, the material of the midsole 10 also fills the button latch openings 30 as shown in FIGS. 5A and 5B. And through collar rings 31 formed in the button latch openings 30 securing on the top side of the cushion pad 22, the dual-layer pad 20 can securely engage with the midsole 10 and cushion pad 22.

Moreover, the pliable pad 21 and cushion pad 22 of the dual-layer pad 20, besides being made from SBS, can also can be made from EVA (Ethyl-vinyl acetate), or be separately made by injection from the two different materials set forth above according to requirements.

Figure 8B:
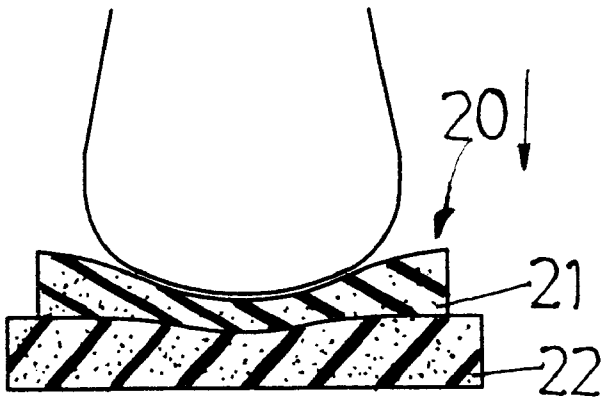
FIG. 8B is another schematic cross section of the dual-layer in an use condition.
Figure 8A:
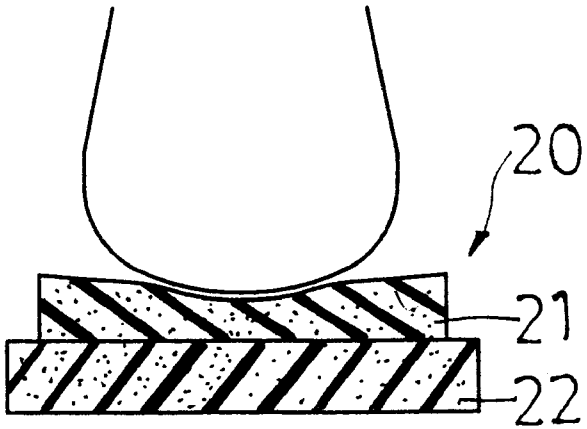
FIG. 8A is a schematic cross section of the dual-layer pad in an use condition.

It is to be noted that, the dual-layer pad 20 and midsole 10 are integrally formed by an injection forming process, and the top surface of the buffer section 23 of the pliable pad 21. are covered by the material of the midsole 10, and the center opening 230, inner layer aperture 231 and outer layer aperture 232 of the buffer section 23 also are filled with the material of the midsole 10. And through the cross support of the inner and outer layer apertures 231 and 232, the buffer section 23 has a desired resilience. Moreover, the concave arched contact surface 233 is located on the heel section of the midsole 10, and has an arched profile matching the contour of the heel, hence when the midsole 10 receives forces, it surrounds the entire heel section as shown in FIGS. 8A and 8B. Therefore, the buffer section 23, in addition to conforming ergonomics and making the heel more comfortable, also expands the force bearing area to the entire heel section and securely supports the bottom of the heel. Hence whatever wearers' wearing conditions, either walking, springing, or jumping, the cushion pad 22 and buffer section 23 provide a bouncing reaction force. More important, the arched contact surface 233 of the buffer section 23 can completely match the heel to provide wearers more comfortable feeling when treading on the arched contact surface 233. And the expanded force bearing surface which surrounds the entire heel section can completely absorb the pressure being transferred, and achieve the cushion and shock-absorbing effect.

Figure 6:
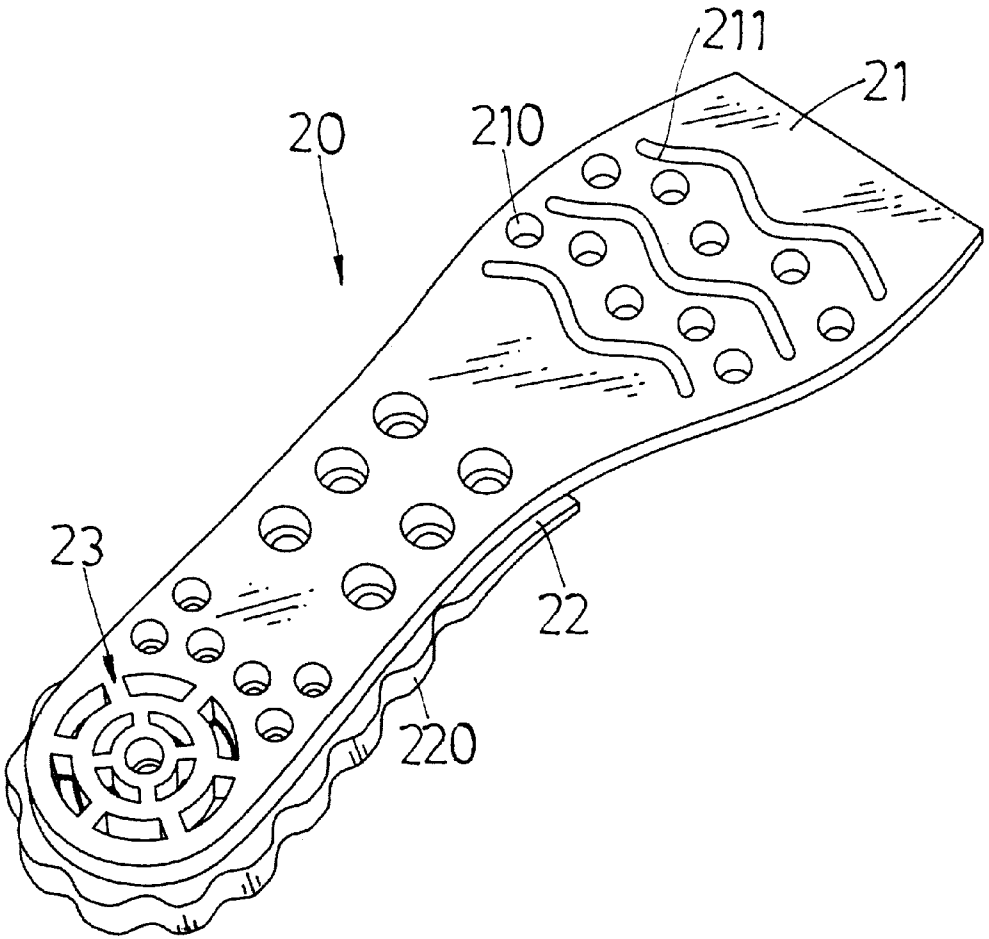
FIG. 6 is a perspective view of another embodiment of the invention.
Figure 7:
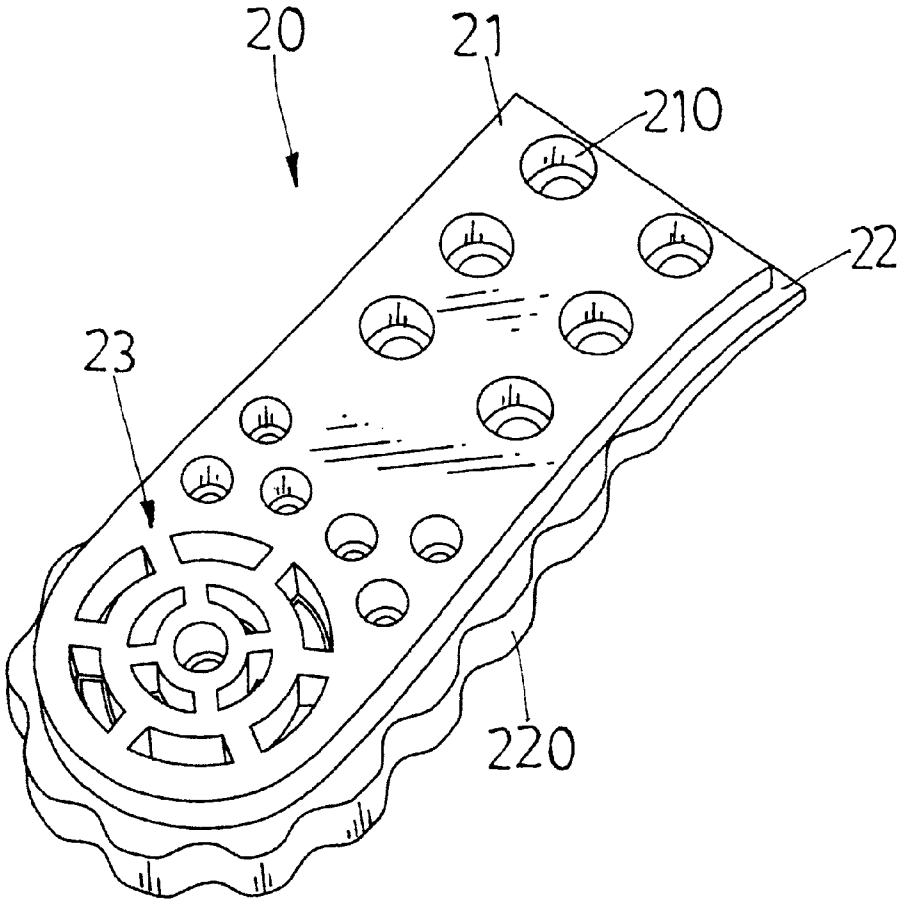
FIG. 7 is a perspective view of yet another embodiment of the invention.

FIGS. 6 and 7 show other embodiments of the invention in which the length of the cushion pad 22 or the entire dual-layer pad 20 are made shorter, and are retracted to the arch portion of the foot. By means of the techniques and constructions set forth above, the invention offers the following advantages:

1. The midsole 10 and dual-layer pad 20 of the invention are integrally made by an injection forming process, thus assembly time required by bonding or stitching of the outsole 1 that incurs to conventional techniques may be dispensed with, production is simpler and the shoe can be worn for a long period of time without breaking away.
2. The dual-layer pad 20 of the invention consists of a pliable pad 21 and a cushion pad 22 made from materials of different soft and hard properties. The softer upper pliable pad 21 provides excellent touch feeling when the sole of wearers' foot pounding on the ground surface (referring to FIG. 8A). And the lower cushion pad 22 provides desired resilience and support function to give the foot bouncing and supporting effect when leaving the ground surface, thus wearers may walk easily with less effort (referring to FIG. 8B).
3. The jutting ribs 220 formed on the peripheral rim of the cushion pad 22 and button latch openings 30 allow materials of the midsole 10 to cover the entire dual-layer pad 20 during the injection forming process, and fill the button latch openings 30 to form a tight and secured bonding between the cushion pad 22 and the midsole 10, thereby can prevent the two from separating.
4. The cushion pad 22 and buffer section 23 generate a bouncing force and provide wearers more comfortable feeling when treading thereon. And the expanded force bearing surface which surrounds the entire heel section can completely absorb the pressure being transferred, and achieve cushion and shock-absorbing effect.

What is claimed is:

1. An integrated injection forming shoe midsole having a dual-layer pad, comprising:

a dual-layer pad and a midsole integrally bonded by an injection forming process, the dual-layer pad including a pliable pad on an upper layer and a cushion pad on a lower layer thereof bonding together; the pliable pad having an upper surface which has a plurality of latch openings and undulate slots formed thereon, the latch openings being run through the dual-layer pad; the cushion pad having a plurality of jutting ribs formed on the peripheral rim thereof, the jutting ribs forming a staggered relationship with rib slots formed on the periphery of the midsole to allow the dual-layer pad tightly and securely bonding to the midsole; the cushion pad further having a buffer section corresponding to a heel location.

2. The integrated injection forming shoe midsole having a dual-layer pad of claim 1, wherein the buffer section has a top surface which has a center opening, an inner layer aperture and an outer layer aperture formed thereon from the center thereof extending outwards, the top surface having a concave and arched contact surface, the center opening, the inner layer aperture and the outer layer aperture being formed symmetrically and running through the dual-layer pad, the inner layer aperture and the outer layer aperture being bridged by inner ribs and outer ribs formed therebetween in a staggered fashion.

3. The integrated injection forming shoe midsole having a dual-layer pad of claim 1, wherein the latch openings, the center opening, the inner layer aperture and the outer layer aperture of the dual-layer pad have respectively larger diameters corresponding to the pliable pad than that in the cushion pad to form button latch openings with a wider upper section and a narrower lower section.

* * * * *